US005245148A

United States Patent [19]

Mohr

[11] Patent Number: 5,245,148

[45] Date of Patent: Sep. 14, 1993

[54] APPARATUS FOR AND METHOD OF HEATING THICK METAL SLABS

[76] Inventor: Glenn R. Mohr, P.O. Box 52, Linthicum, Md. 21090

[21] Appl. No.: 622,973

[22] Filed: Dec. 6, 1990

[51] Int. Cl.[5] ..... H05B 6/06

[52] U.S. Cl. ..... 219/10.43; 219/10.57; 219/10.77; 219/10.71

[58] Field of Search ..... 219/10.41, 10.43, 10.71, 219/10.57, 10.75, 10.77, 10.79, 10.69

[56] References Cited

U.S. PATENT DOCUMENTS

| | | | |
|---|---|---|---|
| 2,669,647 | 2/1954 | Segsworth | 219/10.71 |
| 3,057,985 | 10/1962 | Biringer | 219/10.75 |
| 4,093,839 | 6/1978 | Moliterno et al. | 219/10.71 |
| 4,122,321 | 10/1978 | Cachet | 219/10.41 |
| 4,258,241 | 3/1981 | Soworowski | 219/10.71 |
| 4,315,124 | 2/1982 | Granstrom et al. | 219/10.71 |
| 4,755,648 | 7/1988 | Sawa | 219/10.77 |

OTHER PUBLICATIONS

Simpson: "Induction Heating Coil and System Design", pp. 30–82, McGraw-Hill Book Co., 1960.

*Primary Examiner*—Philip H. Leung

*Attorney, Agent, or Firm*—Charles E. Brown

[57] ABSTRACT

This relates to the heating of thick slabs for rolling and like purposes wherein there is a complete penetration of the slab by induced electrical energy wherein the starting current frequency is very low and wherein a maximum heating is obtained by increasing the current frequency to control through penetration of the induced current in the slab as the temperature of the slab rises and thus the restivity of the metal of the slab increases. Several heating systems are envisioned. These include a heating system of a length corresponding to the length of the slab and wherein the slab is stationary during the heating to the desired temperature, after which the slab is moved out of the heating apparatus. The second arrangement is similar to the first, but wherein a lower coil arrangement moves relative to the upper coil arrangement so as to remove and expose a heated slab. In these two systems, the frequency is progressively increased. In a third system, the heating system is relatively short and the slab being heated is moved therethrough. In this arrangement, there are a plurality of coil sets each having a current supply of a different and gradually increasing frequency.

19 Claims, 9 Drawing Sheets

APPARATUS FOR AND METHOD OF HEATING THICK METAL SLABS

This invention relates in general to electrical induction heating of metal slabs to temperatures suitable for rolling such slabs, and more particularly to a rapid and efficient heating of such slabs utilizing different frequencies in accordance with the resistivity of the metal of such slabs as the temperature of the slabs increase.

BACKGROUND OF THE INVENTION

It is well known to utilize electrical induction heaters to heat thin metal strip to higher temperatures, particularly for annealing purposes. It is also known to heat by induction heating thin strip for the purpose of further reduction of the strip by rolling.

In the past, the frequency of electrical current utilized in conjunction with induction strip heaters has varied from being very high so that the heating is only in the way of skin effect down to 60 Hertz. Such induction heating systems have not proved to be satisfactory for thick slabs in that the induced current only minutely penetrates the thickness of the slab and internal heating must be by way of internal conduction. On the other hand, the exposed surfaces of such a slab is subject to rapid cooling by convection with the result that it is not economically feasible to heat thick slabs utilizing induction heating utilizing a current frequency of 60 Hertz and above.

At the present, 2" inch thick steel slabs are being heated in a gas furnace in an uneconomical process. The difficulty of heating a thick slab utilizing a furnace is that the heating is all done from the outside towards the center of the slab which requires a long period of time for the heat conduction while the heat transferred into the slab is dissipating from the surfaces of the slab.

GENERAL DESCRIPTION OF THE INVENTION

It is known that it is most economical to roll rather thick slabs, particularly steel slabs as opposed to thinner 2" slabs. For example, it is most economical to roll 12" thick steel slabs if the slabs can be properly heated to a rolling temperature on the order of 2800° F. Further, it will be apparent that a most economical electrical induction heating can be effected when there is a through penetration of the electrical energy.

In accordance with this invention, it has been found that most efficient electrical induction heating of a thick slab may be obtained beginning with a very low current frequency, for example, less than 5 Hertz and wherein as the temperature of the slab rises and the resistivity thereof increases, further efficient heating can be obtained by gradually increasing the current frequency.

With the above and other objects in view that will hereinafter appear, the nature of the invention will be more clearly understood by reference to the following detailed description, the appended claims, and the several views illustrated in the accompanying drawings.

Figure 1:
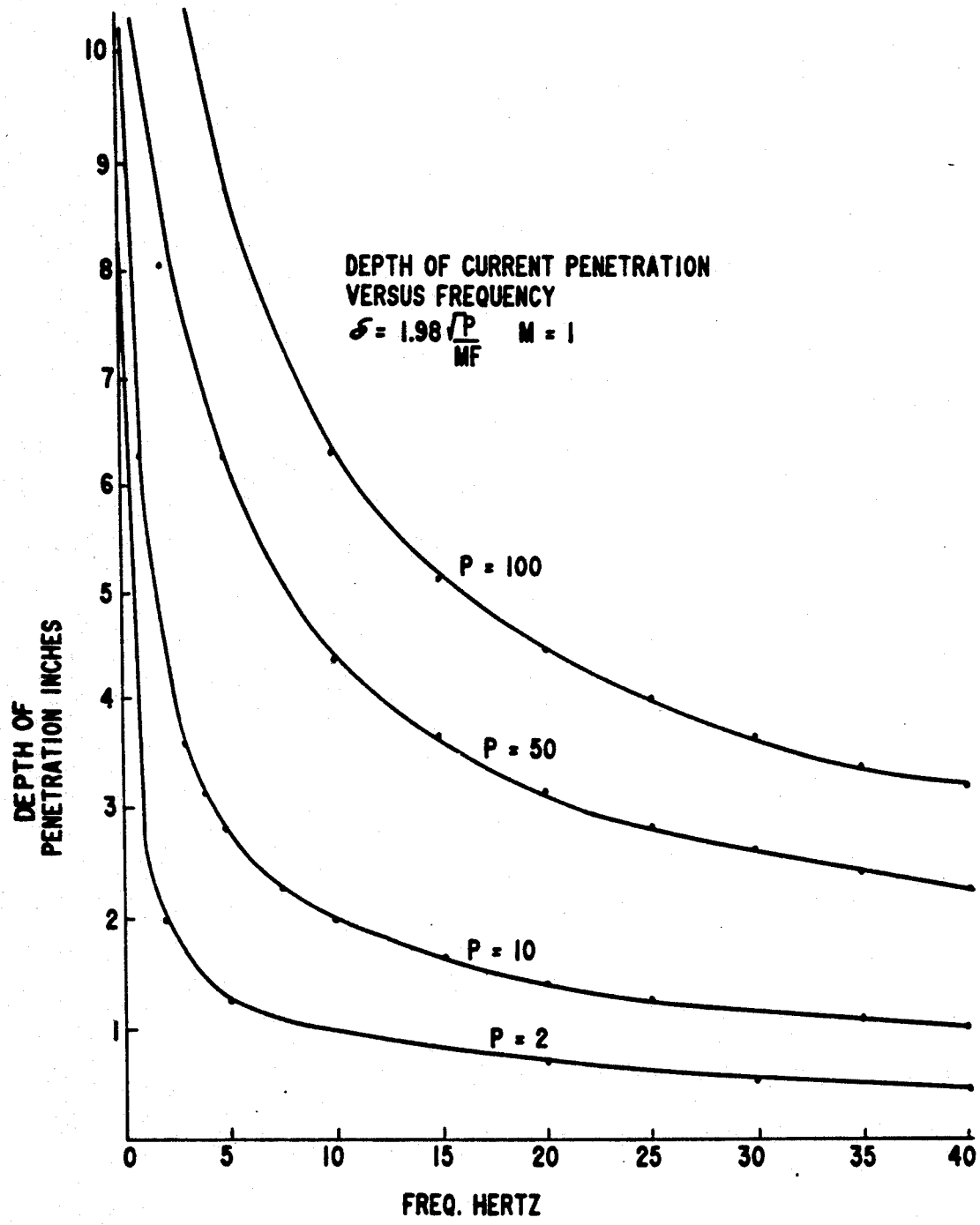
FIG. 1 is a graph plotting depth of current penetration vs frequency.

Reference is made first to FIG. 1 where it is seen that the depth of current penetration increases with a decrease in current frequency. This invention takes advantage of the depth of penetration of the induced current utilizing a very low current frequency.

Figure 2:
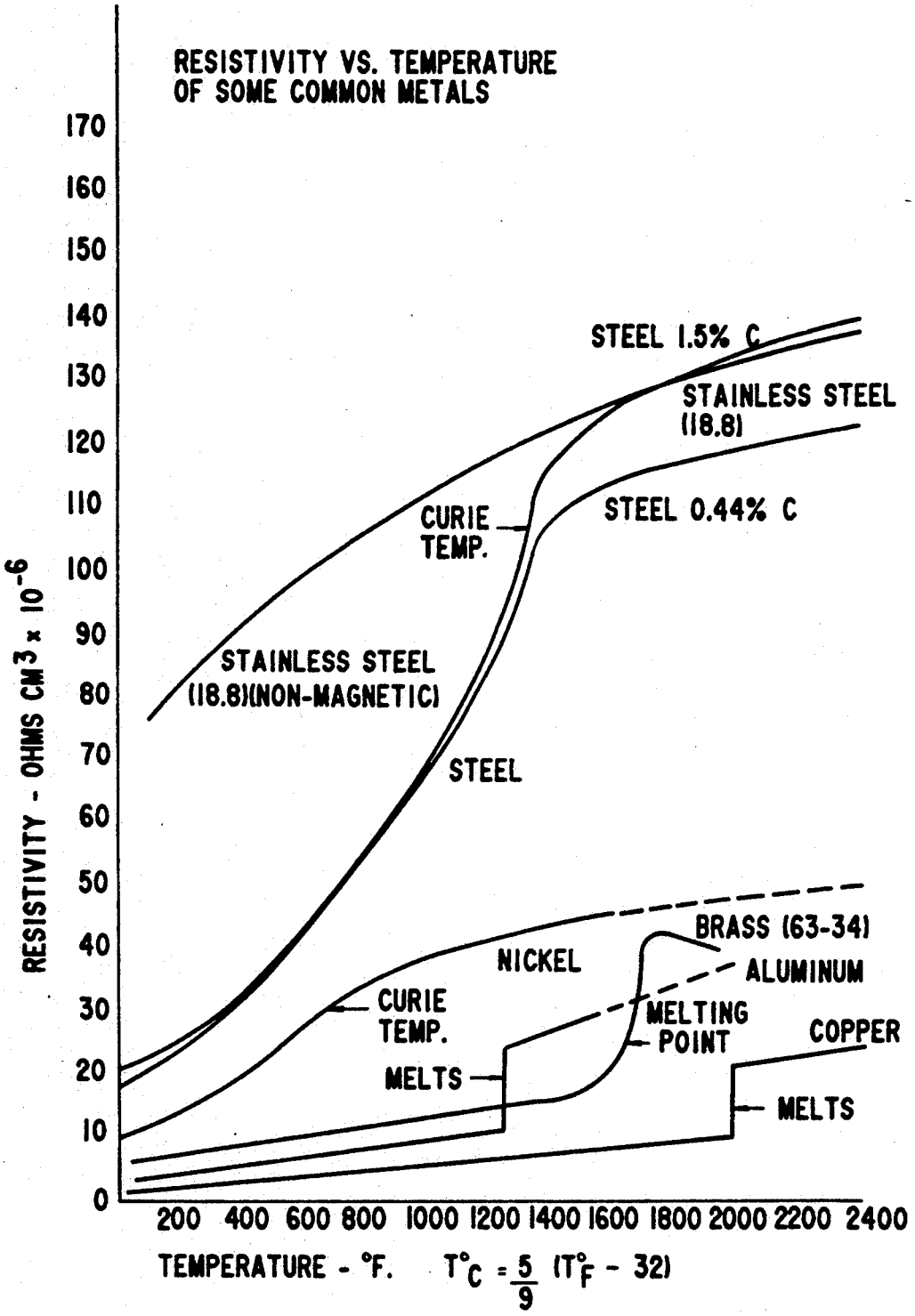
FIG. 2 is a diagram plotting restivity vs temperature of some common metals.

FIG. 2 is a plotting which clearly shows that with different metals as the temperature of the metal increases, the resistivity of the metal also increases.

Figure 3:
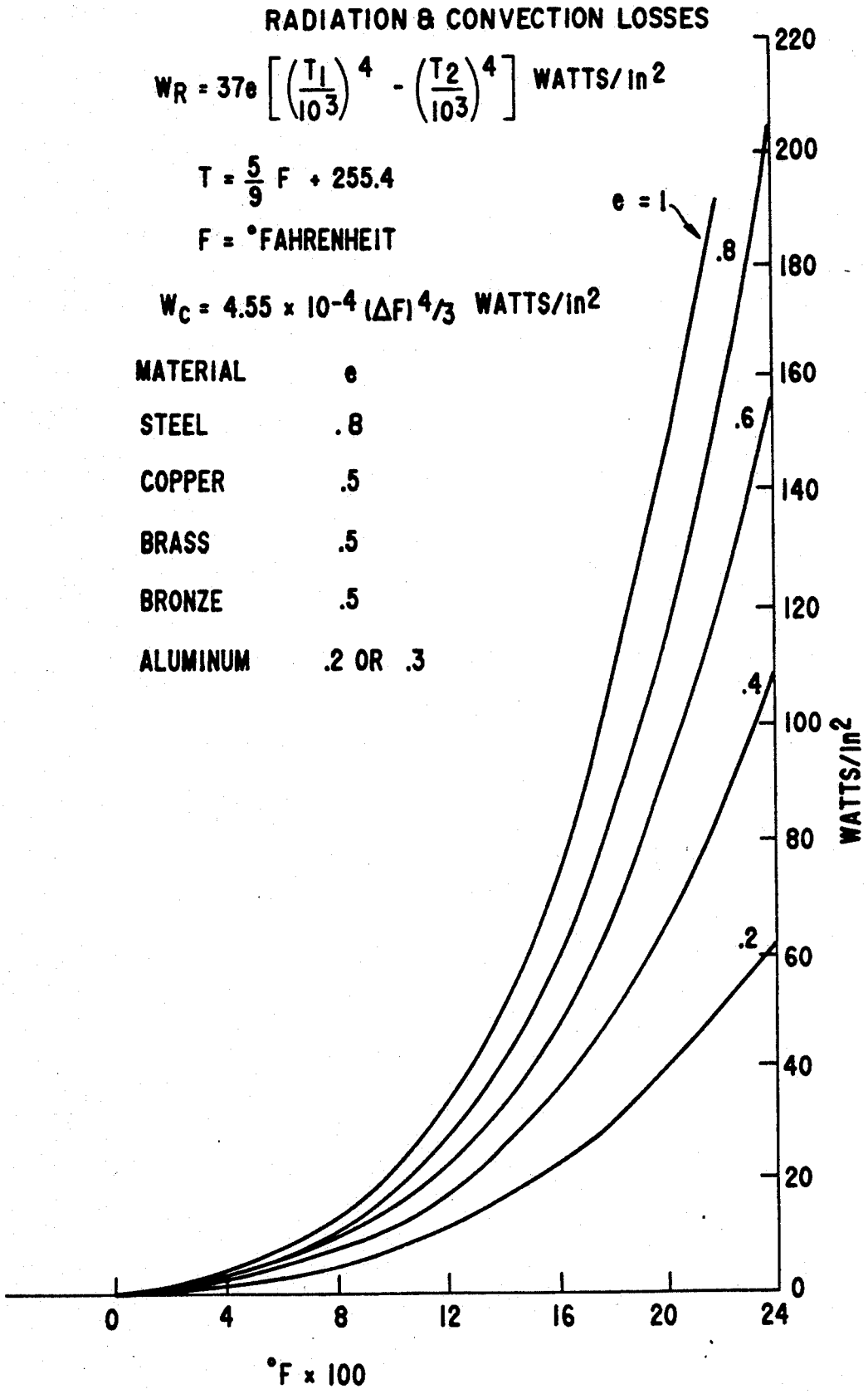
FIG. 3 is a diagram plotting radiation and convection losses of certain metals.
Figure 4:
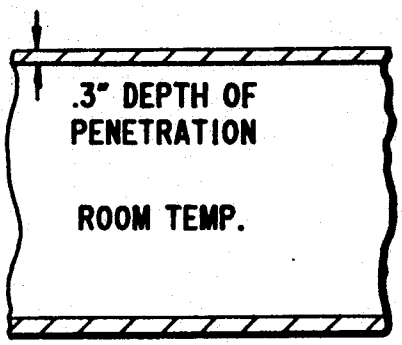
FIG.4 PRIOR ART
FIGS. 4 through 9 are schematic views showing the depth of penetration of induced electrical energy utilizing 60 Hertz current heating a 12" thick steel slab.
Figure 5:
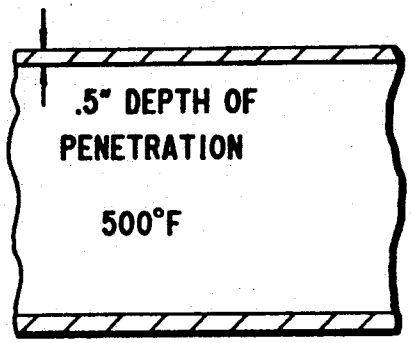
FIG.5 PRIOR ART
Figure 6:
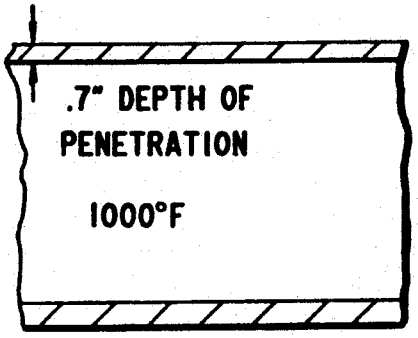
FIG.6 PRIOR ART
Figure 7:
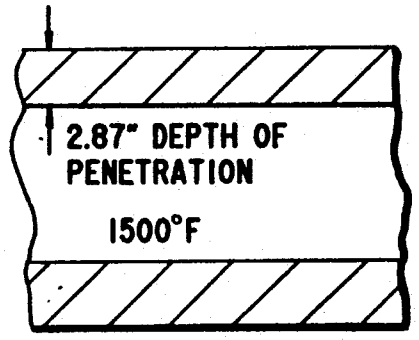
FIG.7 PRIOR ART
Figure 8:
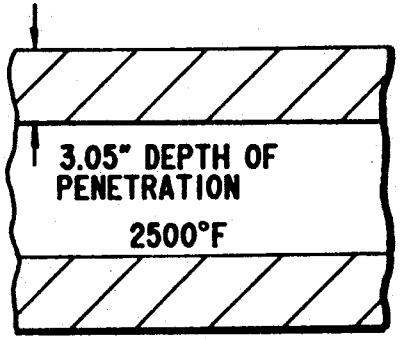
FIG.8 PRIOR ART
Figure 9:
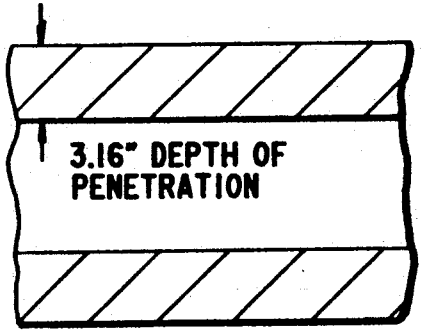
FIG.9 PRIOR ART

FIG. 3 is a plotting of radiation and convection losses in watts/in$^2$ for different metals at different temperatures. It is upon these known physical characteristics that this invention is based.

Reference is now made to the prior art showings of FIGS. 4 through 9 wherein there is schematically illustrated the heating of a 12" deep steel slab utilizing a constant current frequency of 60 Hertz. It will be seen that at room temperature, the depth of penetration from opposite faces of the slab is 0.3". When the temperature of the metal of the slab increases to 500° F., due to the increase in resistivity, the depth of penetration of the 60 Hertz current frequency increases to 0.5". At a temperature of 1000° F., the depth of penetration increases to 0.7" while at 1500° F., the depth of penetration increases 2.87". Next, when the temperature of the heated slab raises to 2500° F., the depth of penetration increases to 3.05" and finally at the desired temperature of 2800° F., the depth of penetration from each face is 3.16". This, however, leaves a center core portion having a thickness of 5.68" wherein there is no current induced and thus substantially one-half of the volume of the slab must be heated by conduction while at the same time there is a very high loss of heat by radiation and convection.

From the foregoing it will be seen that it is not economically feasible to heat a thick slab, such as a 12" thick steel slab, by induction heating utilizing a current frequency of 60 Hertz.

In accordance with this invention, there are three general ways of heating a thick slab, for example a 12" thick steel slab. First of all, it may be desirable to initially heat the slab in a furnace generally identified by the numeral 20 and thereafter heat the slab to the rolling temperature on the order of 2800° F. by an induction heating system generally identified by the numeral 22. The induction heating system 22 includes upper coils or coil sets 24 and lower coils or coil sets 26 as will be described in more detail hereinafter. The coils 24, 26 have connected thereto a power source 28 which has incorporated therein a frequency charger. Simply speaking, the power source may be a D.C. power source which involves no correction factor. The frequency is controlled by a bank of SCRs (not shown) such that by increasing the number of SCRs which are active, the frequency of the current supply to the coils 24, 26 may be increased. For example, the temperatures of the slab 32 may be detected and as the temperature reaches each of a plurality of predetermined levels, the frequency of the current supplied the coils 24, 26 may be increased.

In operation the slab 32 will be passed between the coils 24, 26 with the longitudinal extent of the induction heating system 22 corresponding to the length of the slab 32 to be heated. The slab will be supported by suitable rollers 34 and after the heating has been completed, suitable means will be provided for moving the slab 32 longitudinally on the rollers 34.

Figure 11:
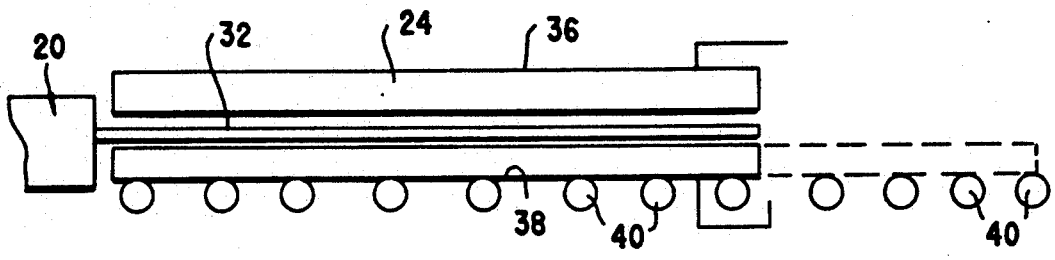
FIG. 11 is a side elevational view of an induction heating system similar to FIG. 10 but wherein the slab being heated is supported by a lower coil set and the slab and coil set are movable together to expose the heated slab for removal.

Reference is made now to FIG. 11 wherein there is illustrated a like heating system generally identified by the numeral 36. It is to be understood that with this heating system, steps are taken to support the slab 32 as it is being heated. Accordingly, while the upper coil set 24 is fixed, a lower coil set 38, which is similar to the coil set 26 is mounted for movement on a plurality of rollers 40.

The coils 24, 38 will be energized with a power source and a frequency changer similar to that provided for the induction heating system 22. The slab 32 is supported by the lower coil set 38 and after the slab 32 has been heated to the desired high temperature, the lower coil set 38 together with the heated slab 32 will be moved out from beneath the upper coil set 24 where it may be readily transported either on further ones of the rollers 40 or other suitable transport means which form no part of this invention.

Figure 12:
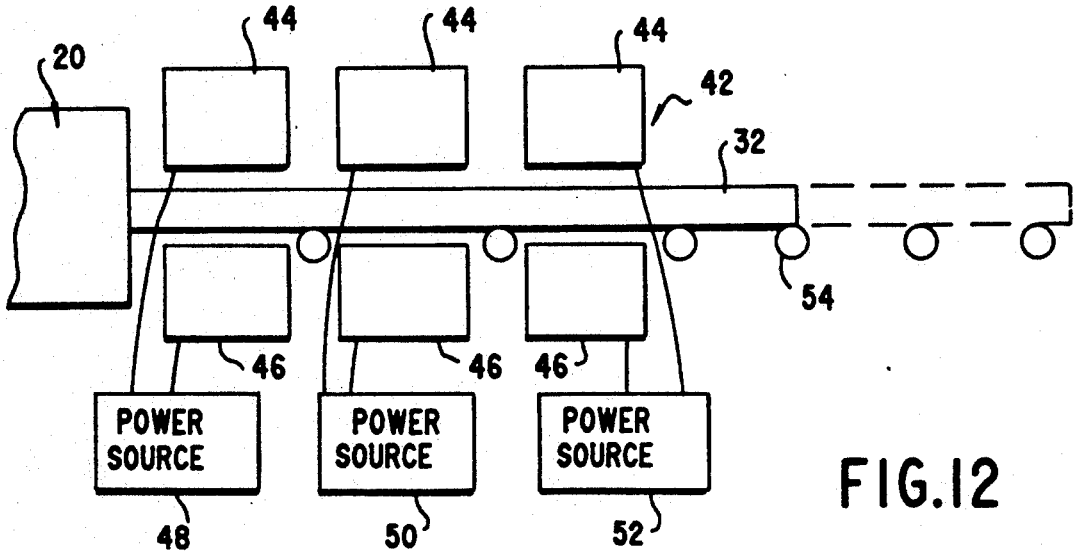
FIG. 12 is an enlarged schematic side elevational view as compared to FIGS. 10 and 11 wherein a slab to be heated is progressively moved between plural sets of induction heaters with each induction heater having a separate power source and the current frequency of the power sources gradually increasing.

With respect to FIG. 12, there is provided an induction heating system generally identified by the numeral 42 which is of a much lesser extent than the length of the slab 32. The heating system 42 includes a group or groups of one or more induction heating coil units each of which includes an upper coil 44 and a lower coil 46. Each coil set or unit is provided with its own power source identified by the numeral 48 for the first coil set, a second power source 50 for a second of the coil sets and a third power source 52 for a third of the induction heating coil sets. Power sources 48, 50 and 52 will provide electrical current to the coil sets at different frequencies with the frequencies progressively increasing in accordance with the temperature of that portion of the slab 32 aligned with the particular induction heating coil set.

The slab 32 is progressively heated as it is passed through the induction heating system 42 and is supported by rollers 54 which may be driven or suitable means may be provided for pushing the slab 32 along the rollers 54.

While in most instances, the slab 32 in FIG. 12 will be heated by way of the furnace 20, it is feasible to entirely heat the slab 32 by induction heating. In a typical arrangement for heating the slab 32 throughout its depth from room temperature to 2800° F., the frequency of current supplied to a first set of coils for a 12" thick steel slab is 2.72 Hertz. At 500° F., the frequency increases to 5.95 Hertz while at a 1000° F., the frequency increases to 12 Hertz.

At 1500° F., the frequency increases to 18.7 Hertz and at 2000° F., the frequency increases to 20.4 Hertz while the final frequency starting at 2500° F. is 21.3 Hertz.

Figure 10:
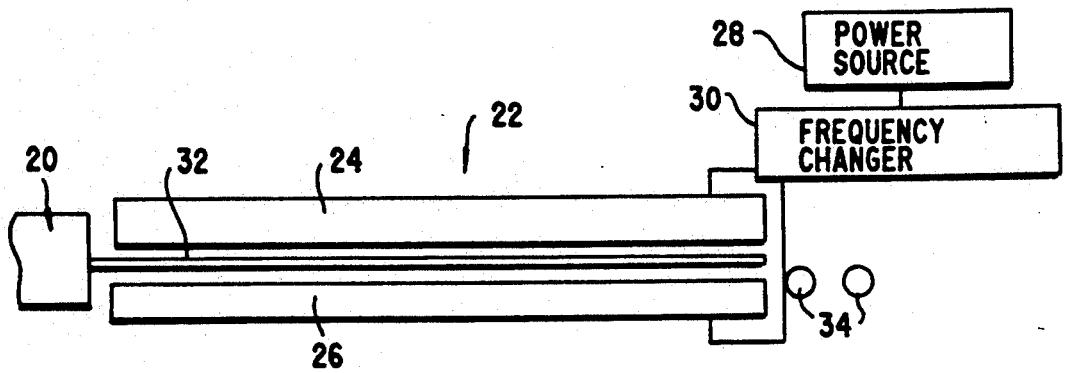
FIG. 10 is a schematic side elevational view showing the heating of a thick slab with the slab being stationary within a set of induction heaters.

The foregoing current frequency variation will also be applicable to the embodiments of FIGS. 10 and 11.

Figure 13:
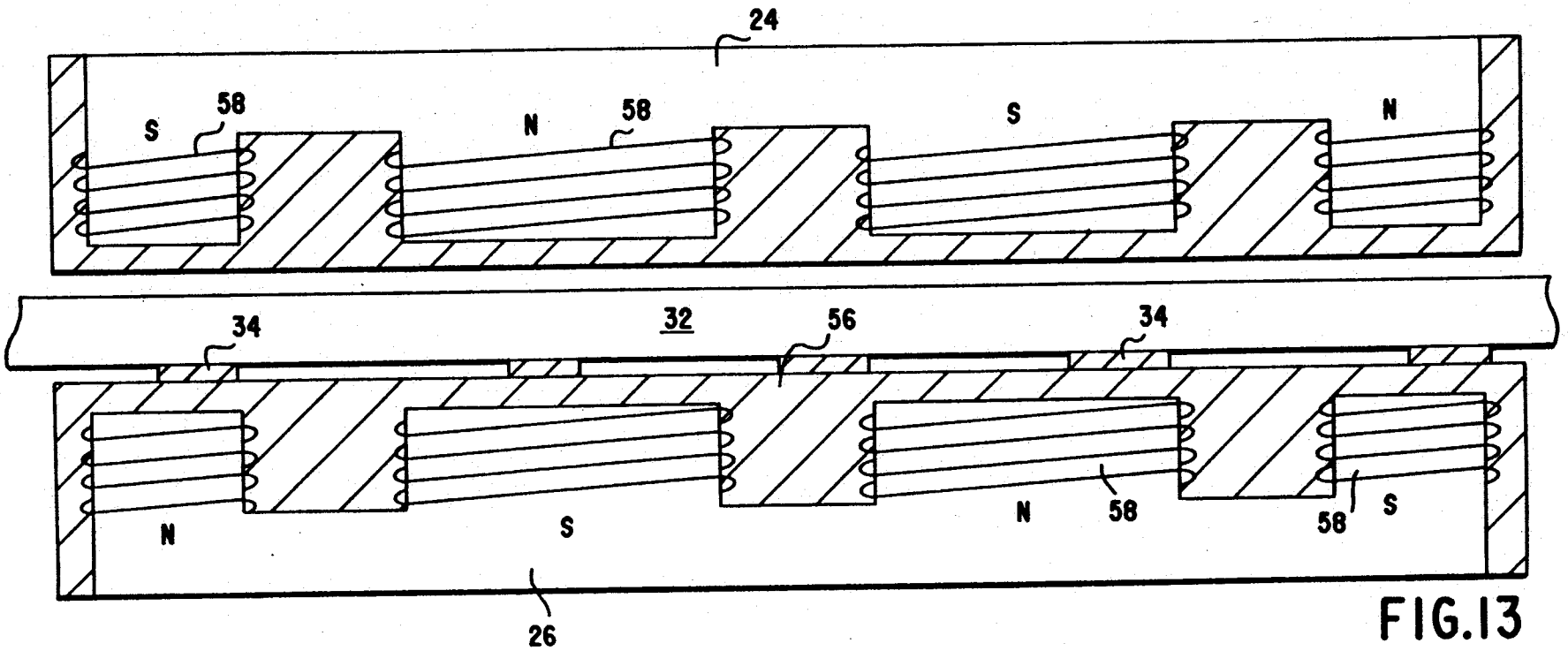
FIG. 13 is an enlarged fragmentary elevational view showing a typical induction heater set.

FIG. 13 is now referred to as showing a typical upper and lower coil arrangement such as the coils 24, 26. The coils 24, 26 are of conventional construction and are spaced apart so that the slab 32 may pass therebetween. Furthermore, each of the coils 24, 26 is provided with a facing of insulation 56 which serves to restrict the loss of heat from the slab 32 being heated by radiation and convection as shown by the diagram of FIG. 3.

Figure 14:
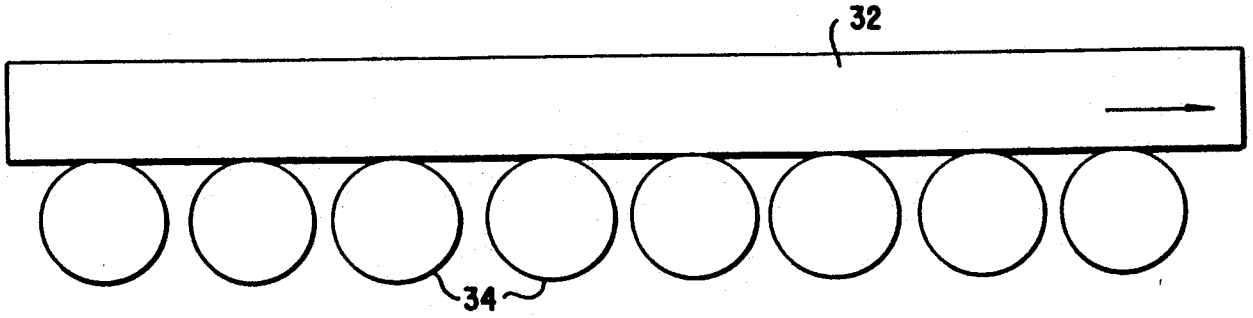
FIG. 14 is a schematic side elevational view showing the manner in which a slab is supported for longitudinal movement on a series of rollers.

The slab 32 is carried by suitable supports which may be like the rollers 34 or the roller 54. The rollers 34 are best illustrated in FIG. 14 for supporting the slab 32. It is to be understood that the coil and roller support arrangement shown in FIGS. 13 and 14 are equally as well applicable to FIGS. 10 and 12 except that in FIG. 10 the same current frequency is supplied to each of the windings 58 and the frequency of the supplied current will be changed at temperature intervals when the slab 32 is stationary while being heated as shown in FIG. 10. On the other hand, if the coil arrangement of FIG. 13 constitutes one of the coil sets of FIG. 12, the current supplied to the coils 58 will be of a constant frequency, but will increase sequentially in adjacent ones of such coil sets.

Figure 15:
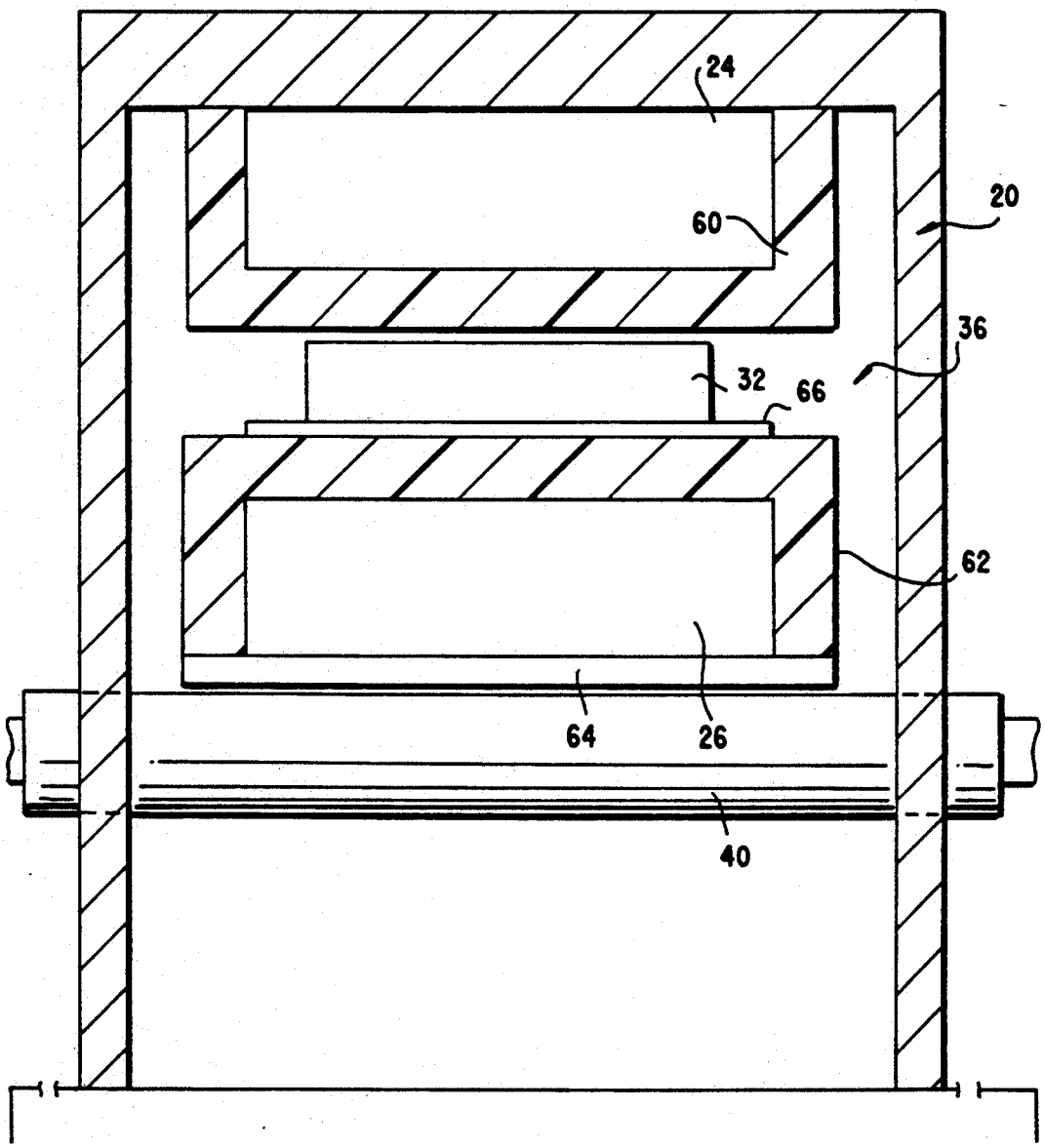
FIG. 15 is a schematic sectional view taken through the heating system of FIG. 11 and shows the relationship of various components.
Figure 16:
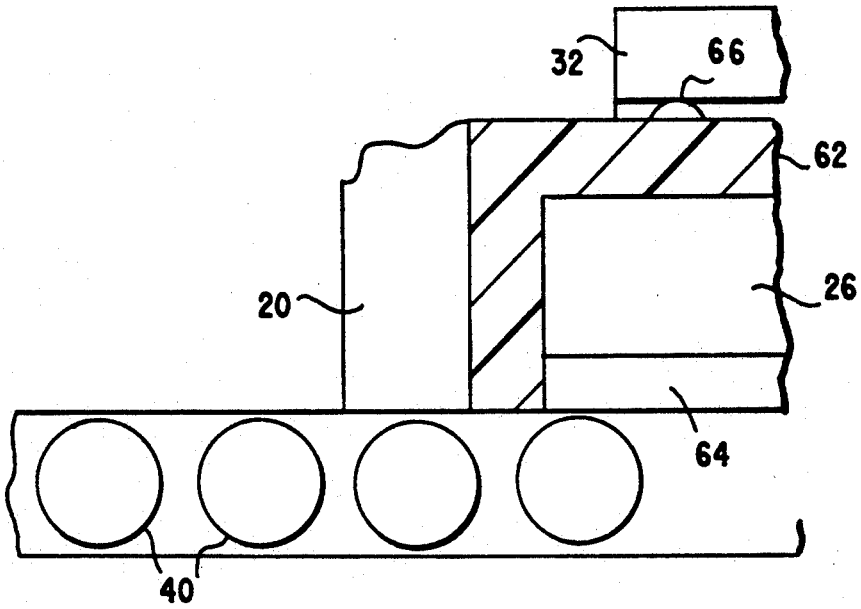
FIG. 16 is a fragmentary side elevational view with parts broken away and shown in section showing further details of the induction heating system of FIG. 15.

Reference is now made to FIGS. 15 and 16 which relate to the induction heating system 36 of FIG. 11. The induction heating system 36 is positioned as being adjacent the furnace 20 as shown in FIG. 11, and if desired, the furnace 20 may be continued to supply external heat to the slab 32. The upper coil 24 is encased in insulation 60 while the lower coil 32 is encased in insulation 62. Further, the lower coil 62 is carried by a support 64 which is also provided with a suitable support 66 for supporting the slab 32. The lower coil 26, the slab 32 and the coil support 64 are all mounted on a set of rollers 40 as illustrated in FIG. 11.

It is to be understood that the upper coil 24 is stationary while the coil-support 64, the lower coil 66, the insulation 62 for the lower coil, the support 66 and the slab 32 are all mounted on the rollers 40 by way of the support 64 for movement as a unit. The induction heating system 36 is of a linear extent corresponding to the length of the slab 32. After the slab 32 is heated to the desired temperature, i.e. a temperature on the order of 2800° F., it has little integral strength and is moved from beneath the upper coil 24 to a position where it may be readily engaged from the top and suitably moved to a rolling mill.

Figure 17:
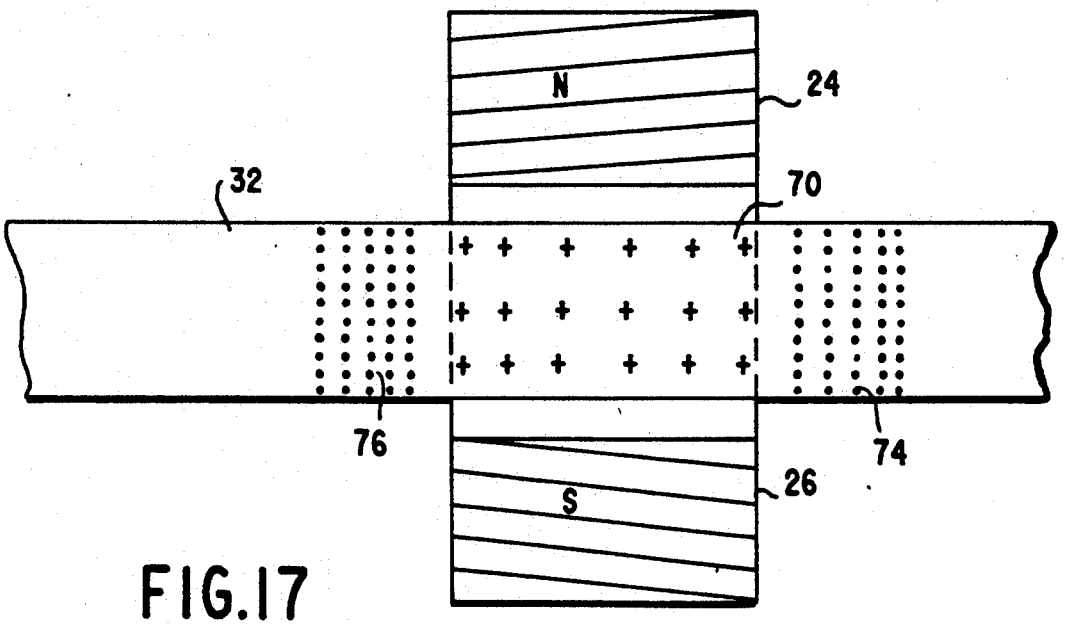
FIG. 17 is a side elevational view schematically showing the heating of a thick slab by a single induction heater.
Figure 18:
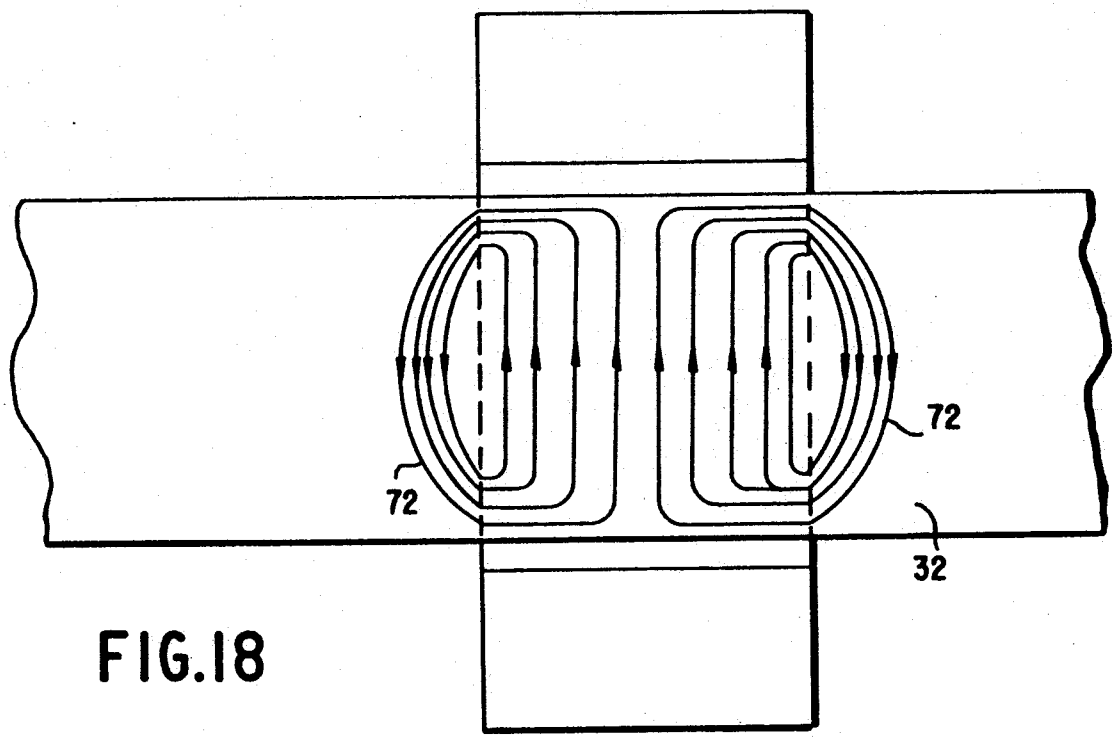
FIG. 18 is a schematic plan view showing the heat pattern within a thick slab from the set of induction heaters of FIG. 17.

Reference is now made to FIGS. 17 and 18 wherein there is schematically illustrated the heating of the slab 32 by an induction heating coil arrangement including the upper coil 24 and the lower coil 26. It will be seen that the induced current pattern as shown in FIG. 18 provides for a maximum concentration of heat in alignment with the coils 24, 26 as at 70 in FIG. 17. On the other hand the induced current is not restricted to being aligned with the coils 24, 26, but there is a certain degree of brooming out as at 72 in FIG. 18 which results in a minor degree of heating in front of and behind the coils 24, 26 as at 74 and 76 in FIG. 17.

Further, it is to be understood that in lieu of there being a single coil arrangement, the coil arrangement is a plurality of coils as shown in FIG. 13 that generally oppose the brooming out as at 72 shown in FIG. 18, the induced current flow will be substantially all parallel to one another.

It is also pointed out here that the coil size is preferably one wherein the induced current is not for the full width of the slab 32. As is best shown in FIG. 18, it is preferred that with a 60" wide slab, for example, the effective heating would be only for a width of 50" but centered on-the slab so that there may be heating along the edges of the slab by conductions thereby eliminating any possibility of hot spots.

At this time it is pointed out that while with a steel slab having a thickness of 12" the starting current frequency is only 2.72 Hertz, it is to be understood that if the slab is preheated to, for example, 1000° F., then the starting frequency will be 12 Hertz.

Although only several preferred embodiments of induction heating systems at low frequencies have been specifically illustrated and described herein, it is to be understood that minor variations may be made in the method of heating and the apparatus for heating thick slabs without departing from the spirit and scope of this invention as defined by the appended claims.

I claim:

1. A method of through induction heating a metal slab to a slab rolling temperature, said method comprising the steps of initially induction heating the metal slab at a first current frequency to obtain through induction heating penetration, and continuing said induction heating with changes in said current frequency as through heated slab temperature increases with a resultant slab resistivity increase.

2. A method according to claim 1 wherein said slab is stationary at the time of heating utilizing a single induction heater set and the current frequency to the single induction heater set is changed.

3. A method according to claim 1 wherein said slab is moved through plural induction heater sets in sequence, and frequencies of current supplied to said induction heater sets are different.

4. A method according to claim 1 wherein slab thickness is one wherein initial current frequency is 5 Hertz and less.

5. A method according to claim 4 wherein the metal of said slab is steel and slab thickness on the order of 9 inches and above.

6. A method according to claim 4 wherein said current frequency is no greater than 60 Hertz.

7. A method according to claim 1 wherein the frequency is defined by the equation:

$$F = \frac{24.5\, P\, g\, 10^6}{\mu\, t\, L_o^2} \text{ Hertz}$$

wherein

P=slab resistivity (ohm cms) and g=air gap (inches) and $\mu$=permability and t=slab thickness (inches) and $L_o$=pole pitch (inches)

8. A method according to claim 7 wherein initial heating of the slab is effected in a furnace.

9. A method according to claim 1 wherein said current frequency is no greater than 60 Hertz.

10. A method according to claim 1 wherein the slab is insulated to restrict heat loss.

11. A method according to claim 1 wherein the induction heating is effected by upper and lower coils with said upper coil being fixed and said lower coil being movable together with the slab being heated.

12. An apparatus for through induction heating metal slabs, said apparatus comprising upper and lower induction heating coils, means for passing a metal slab to be heated between said coils along a path, an electrical current supply coupled to said coils for inducing electrical energy into a slab positioned between said coils to induction heat said slab through the entire thickness of said slab, and means for providing current frequency to said coils in accordance with the thickness and resistivity of the slab being heated.

13. Apparatus according to claim 12 wherein the means for providing current frequency includes means for changing current frequency to said coils.

14. Apparatus according to claim 13 wherein there is a single set of coils and said means for changing current frequency is operable to increase the current frequency as temperature and resistivity of a metal slab being through heated increases.

15. Apparatus according to claim 12 wherein there are a plurality of coil sets spaced along a path of slab movement, and frequency of current supplied to said plural coil sets is different and in increasing order.

16. Apparatus according to claim 12 wherein there is insulation between said coils and said slab path for reducing heat loss from a slab being heated.

17. Apparatus according to claim 12 wherein said lower coils include support means for a slab being heated, and there are means supporting said lower coils for movement in the direction of said slab path to effect discharge of a heated slab.

18. Apparatus according to claim 17 wherein there is insulation between said coils and said slab path for reducing heat loss from a slab being heated.

19. Apparatus according to claim 12 wherein there is a furnace in which a slab is partially heated, and said upper and lower induction heating coils are positioned adjacent said furnace for receiving a partially heated slab.

* * * * *